US007479602B2

(12) United States Patent
Ju

(10) Patent No.: US 7,479,602 B2
(45) Date of Patent: Jan. 20, 2009

(54) FLAT CABLE

(75) Inventor: Ted Ju, Keelung (TW)

(73) Assignee: Lotes Co., Ltd, Kelung (TW)

( * ) Notice: Subject to any disclaimer, the term of this patent is extended or adjusted under 35 U.S.C. 154(b) by 0 days.

(21) Appl. No.: 11/634,296

(22) Filed: Dec. 6, 2006

(65) Prior Publication Data

US 2008/0135276 A1 Jun. 12, 2008

(51) Int. Cl.
*H01B 7/08* (2006.01)

(52) U.S. Cl. ..... 174/117 FF

(58) Field of Classification Search ..... 174/117 F, 174/117 FF, 260; 333/238
See application file for complete search history.

(56) References Cited

U.S. PATENT DOCUMENTS 4,845,311 A * 7/1989 Schreiber et al. ..... 174/36

* cited by examiner

*Primary Examiner*—Chau N Nguyen
(74) *Attorney, Agent, or Firm*—Birch, Stewart, Kolasch & Birch, LLP

(57) ABSTRACT

The invention provides a flat cable including an insulator and a plurality of connectors disposed in the insulator. The conductors in the insulator are arranged in at least three layers. The width of the conductors in the middle layer is less than or equal to that of the conductors in the middle layer. Comparing with the prior art, by disposing multi-layer conductors in the insulator, the flat cable of the invention can transmit high frequency signals, the cost is cheap, and the performance/price ratio is high to manufacture in bulk, which accords with the trend of fast development of the electronics industry in the information age.

5 Claims, 3 Drawing Sheets

FLAT CABLE

BACKGROUND OF THE INVENTION

1. Field of the Invention

This present invention relates to a flat cable.

2. Description of the Prior Art

Currently, there is a variety of signal wires for transmitting signals in the industry. The signal wires are different based on the differences of the transmitted signals. Currently, some of the more commonly seen signal wires are twisted pair cable, coaxial cable, optical fiber cable, flat cable capable of transmitting multi-signals, and so on. Among these, the twisted pair cable is much cheaper, but the frequency of the signal transmission is lower. When the frequency is higher, because there is no shielding between the signal wires, the transmitted signals over contiguous signal wires are heavily interfered, the accuracy of the signal transmission lowers, and the transmission speed is also much constrained. Thus, comparing with the twisted pair cable, the performance of the coaxial cable and the optical fiber cable is better; that is, high frequency signal can be transmitted, and the transmission speed is fast, but the cost is more expensive.

As IT industry develops faster, the data rate is higher and higher, the data volume is bigger and bigger, the frequency is higher and higher, and the request for the transmission carrier is tougher and tougher. A flat cable as the carrier of multi-data transmitted simultaneously satisfies the requirement of high volume of data and high speed of transmission, and to a certain extend, it also solves the interference problem in high frequency transmission, such as cross talk and so on. However, the present flat cable either simply eliminates the cross talk by cross arranging signal terminals and ground terminals or shields the entire signal wires with a shielding layer similar to a coaxial cable. The shielding efficiency of the former is worse, and there is still an interference problem in transmitting high frequency signals. The shielding efficiency of the latter is very good, the division property is also fine, but the cost is too expensive to manufacture in bulk.

Therefore, there is a need to design a new flat cable to solve the defects mentioned above.

SUMMARY OF THE INVENTION

The scope of the present invention provides a flat cable. Its structure is simple and can efficiently transmit high frequency signals, and the performance/price ratio is high, so it is desirable to manufacture in bulk.

To achieve the above scope, the flat cable of the invention includes an insulator and a plurality of conductors disposed in the insulator. The conductors are arranged in at least three layers in the insulator. The length of the conductors arranged in the middle layer is less than or equal to that of the conductors arranged in the two contiguous layers.

Comparing with the prior art, by disposing multi-layer conductors in the insulator, the flat cable of the invention can transmit high frequency signals, the cost is cheap, and the performance/price ratio is high to manufacture in bulk, which accords with the trend of fast development of the electronics industry in the information age.

The advantage and spirit of the invention may be further understood by the following description together with the appended drawings.

BRIEF DESCRIPTION OF THE APPENDED DRAWINGS

DETAILED DESCRIPTION OF THE INVENTION

The following further describe the invention with the attached figures and the embodiments.

Figure 1:
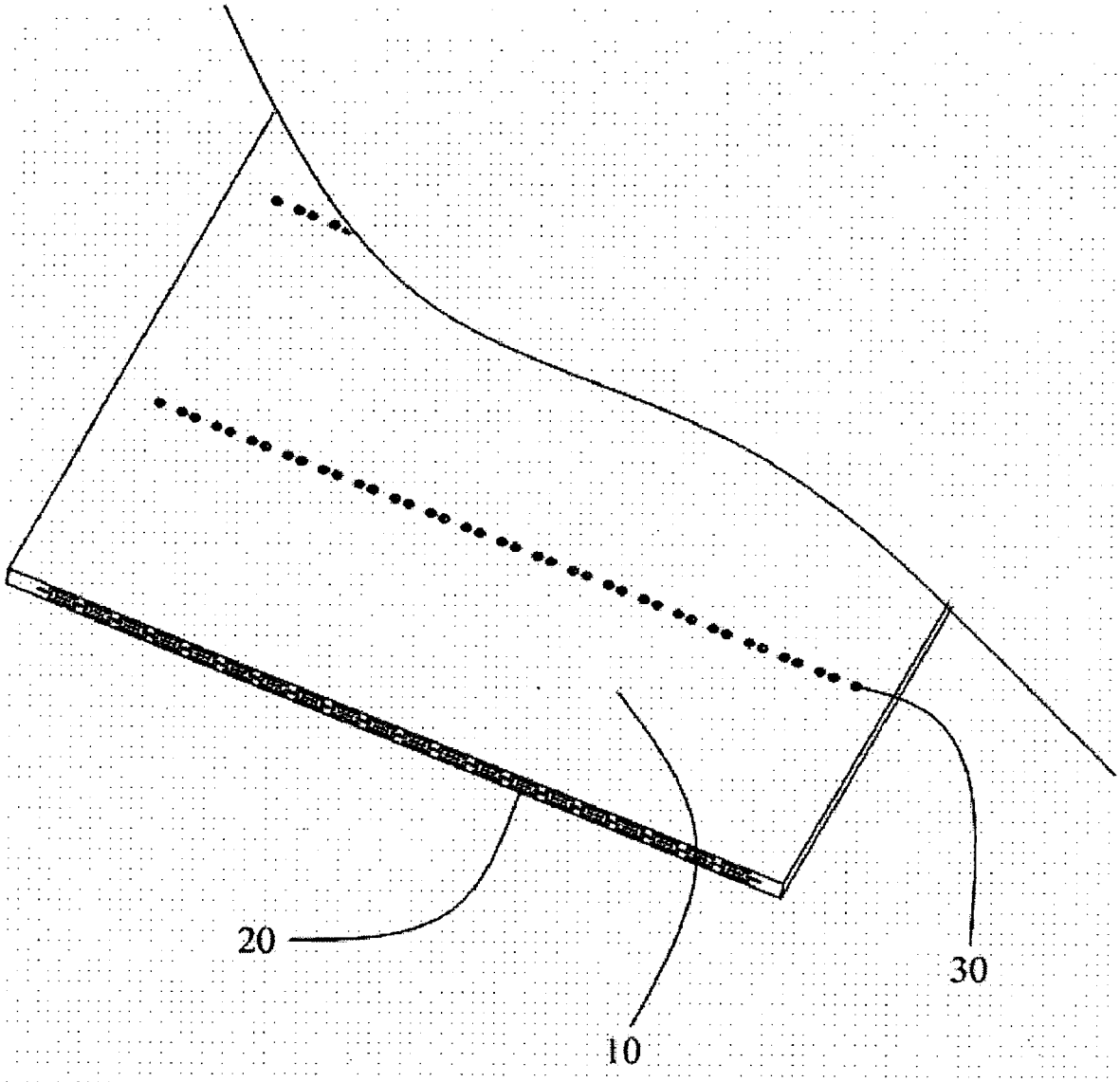
FIG. 1 is an assembly diagram of the flat cable of the invention.
Figure 2:
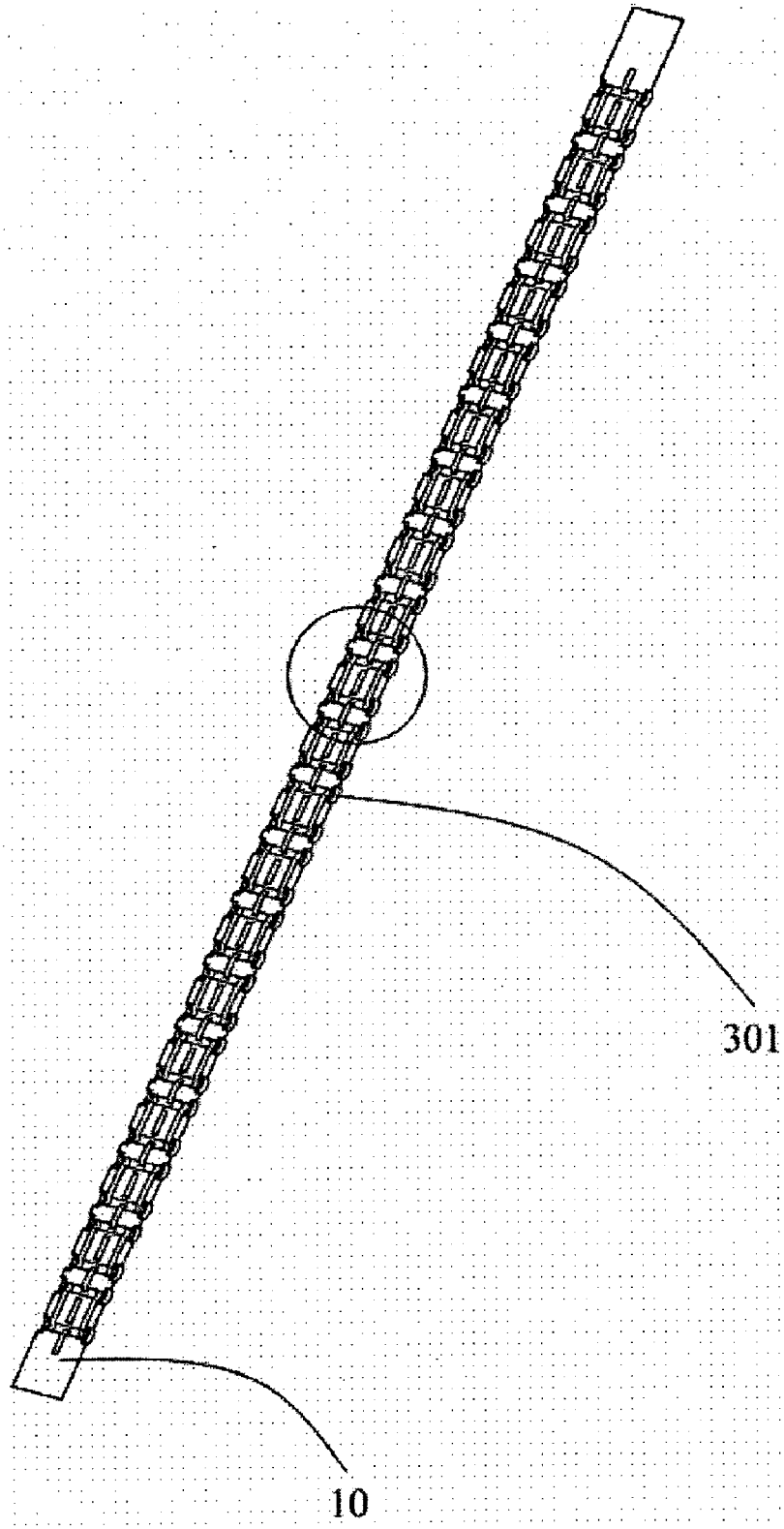
FIG. 2 is a cross section of the through holes of the flat cable shown in FIG. 1.
Figure 3:
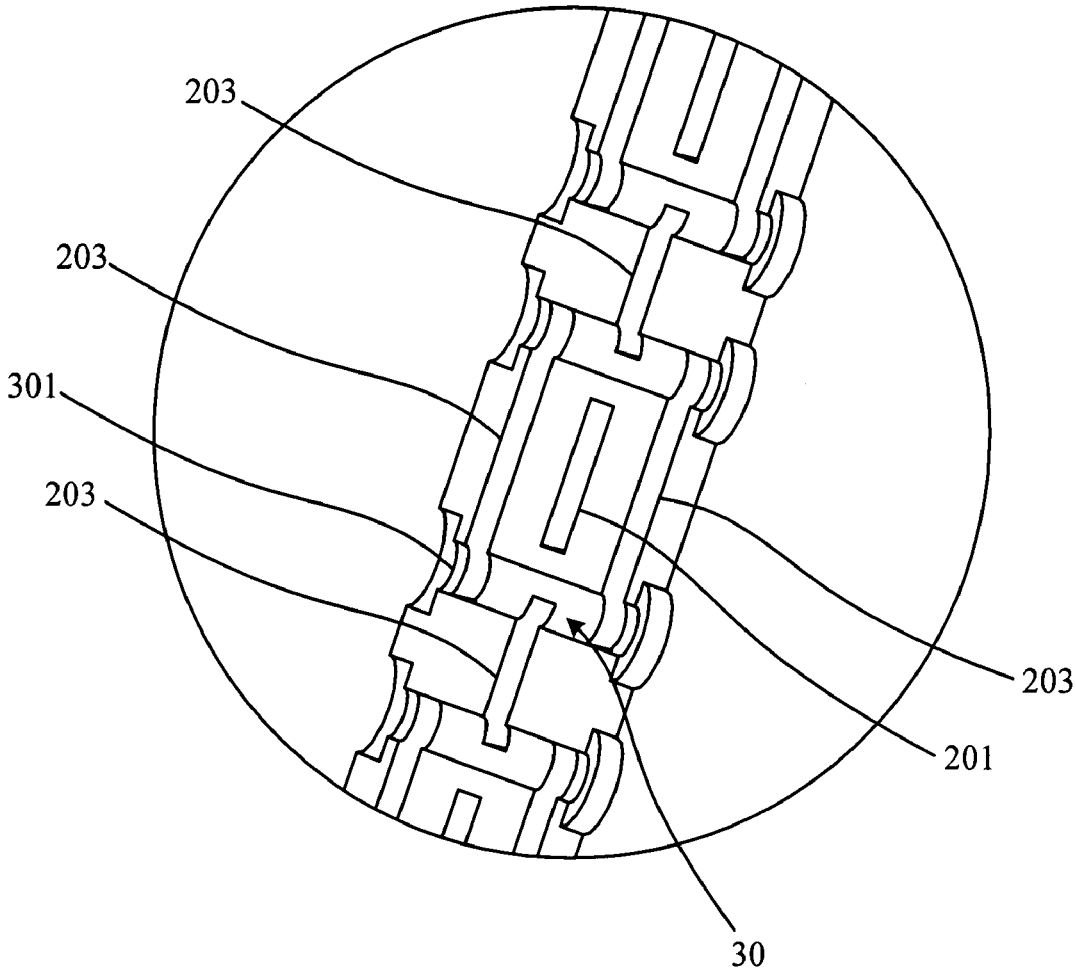
FIG. 3 is an enlarged diagram of a part of the cross section of the flat cable inside the circle shown in FIG. 2.

Referring to FIGS. 1 to 3, a flat cable of the invention includes an insulator 10 and a plurality of conductors 20. The conductors 20 are disposed in several layers in the insulator 10.

The conductors 20 include a plurality of signal conductors 201 and a plurality of shielding conductors 203. The conductors 20 are arranged in three layers in the insulator 10. The signal conductors 201 are disposed in the middle layer. Those disposed in the upper layer and the lower layer are the shielding conductors 203, whose width is longer than that of the signal conductors 201. Those disposed at the sides of the conductors 201 in the same level as the conductors 201 are another two shielding conductors 203; in other words, the signal conductors 201 are at the center, and there are grounded shielding conductors 203 on the four sides: top, bottom, right, and left, and the shielding conductors 203, disposed in the upper layer, the lower layer, and the middle layer, overlap each other.

Furthermore, the insulator 10 has a plurality of holes 30. The holes 30 are formed at where the shielding conductors 203 in the upper layer and the lower layer overlap the shielding conductors in the middle layer. A plurality of connecting conductors 301 connecting the shielding connectors in the three layers are disposed in the holes 30. Thus, two of the holes 30 are disposed on four of the shielding conductors 203 surrounding each of the signal conductors 201. The said four shielding conductors 203 are connected as an electrically-connected cyclic entity. The holes 30 can be formed in a row at an end of the flat cable of the invention (not shown in figures) or be formed in multi-rows (as shown in FIG. 1). Of course, the transmission efficiency of disposing multi-row grounded shielding conductor will be better, which is arranged depending on a production request.

It can be known from the principle of electromagnetism that when a signal conductor is surrounded by a grounded shielding conductor, and a signal is transmitted, the electromagnetic field is constrained between the signal conductor and the shielding conductor; therefore, the attenuation is low, and the cross talk between the signal conductor and contiguous signal conductors is low, which is advantageous to transmitting high frequency signals.

In the flat cable of the invention, every two signal conductors 201 share one of the shielding conductors 203 in the middle layer, so the number of the shielding conductors 203 is reduced as a whole, the volume of the flat cable is shrunk, and the cost is reduced. The signal conductors 201 can also be one, or two, or more signal conductors transmitting signals from a signal source. In the production of the whole flat cable, the flat cable can be made by disposing the conductors 20 in the one-layer insulator 10 or disposing the conductors 20 in two or more insulators (not shown in figures) and then combining them into one.

Therefore, the manufacturing of the flat cable of the invention is simple, the cost is low, and the quality of the signal transmission is high, which is desirable to manufacture in bulk.

With the recitations of the preferred embodiment above, the features and spirits of the invention will be hopefully well described. However, the scope of the invention is not restricted by the preferred embodiment disclosed above. The objective is that all alternative and equivalent arrangements are hopefully covered in the scope of the appended claims of the invention. Accordingly, the above disclosure should be construed as limited only by the metes and bounds of the appended claims.

What is claimed is:

1. A flat cable, comprising:

an insulator;

a plurality of signal conductors, disposed in the insulator; and a plurality of shielding conductors, wholly disposed in the insulator, wherein the shielding conductors are disposed in at least three layers in the insulator;

wherein each of the signal conductors is surrounded by some of the shielding conductors, a plurality of holes are formed through the insulator, a plurality of connecting conductors connecting the shielding conductors are disposed in the holes, and the holes are formed where the shielding conductors in the upper layer and the lower layer overlap the shielding conductors in the middle layer.

2. The flat cable of claim 1, wherein the holes are formed in at least one row.

3. The flat cable of claim 1, wherein the width of the signal conductors is less than or equal to that of the shielding conductors.

4. The flat cable of claim 1, wherein the signal conductors and the shielding conductors are disposed in at least two insulators.

5. The flat cable of claim 1, wherein each of the signal conductors is surrounded by four of the shielding conductors, said four shielding conductors and said signal conductor are arranged in three layers in the insulator, said shielding conductors in the upper layer and in the lower layer overlap said shielding conductors in the middle layer, a plurality of holes are formed in the insulator where said shielding conductors in the upper layer and in the lower layer overlap said shielding conductors in the middle layer, and a plurality of connecting conductors connecting said shielding conductors are disposed in the holes.

* * * * *